United States Patent [19]

Robinson

[11] 4,206,515

[45] Jun. 10, 1980

[54] ATHLETIC SOCK

[76] Inventor: James D. Robinson, 290 Dewey Pl., Teaneck, N.J. 07666

[21] Appl. No.: 943,045

[22] Filed: Sep. 18, 1978

[51] Int. Cl.[2] ..... A41B 11/02

[52] U.S. Cl. ..... 2/241

[58] Field of Search ..... 2/241, 239, 240, 97, 2/24, 61

[56] References Cited

U.S. PATENT DOCUMENTS

| | | | |
|---|---|---|---|
| 1,355,177 | 10/1920 | Sollen | 2/97 X |
| 2,293,714 | 8/1942 | Craig et al. | 2/239 |
| 2,449,410 | 9/1948 | Polinsky | 2/239 X |
| 2,600,864 | 6/1952 | Fuller | 2/239 X |
| 2,771,691 | 11/1956 | Luchs | 2/239 X |
| 3,510,882 | 5/1970 | White | 2/239 |
| 4,008,350 | 2/1977 | Crawford et al. | 2/239 X |

FOREIGN PATENT DOCUMENTS

| | | | |
|---|---|---|---|
| 575414 | 4/1924 | France | 2/241 |
| 22039 | of 1898 | United Kingdom | 2/241 |

*Primary Examiner*—H. Hampton Hunter

[57] ABSTRACT

Athletic foot apparel essentially in the form of a sock includes portions adapted to provide muscular support to the calf and ankle and a padded bottom portion for effectively absorbing shocks imparted to the foot during athletic activity. The ankle and calf portions include a layer of elastic material with the elastic material of the ankle portion being spaced from the elastic material of the ankle portion. Each layer of elastic material is disposed between inner and outer layers of fabric material. The padded bottom portion is secured to the sock and may be comprised of latex.

3 Claims, 2 Drawing Figures

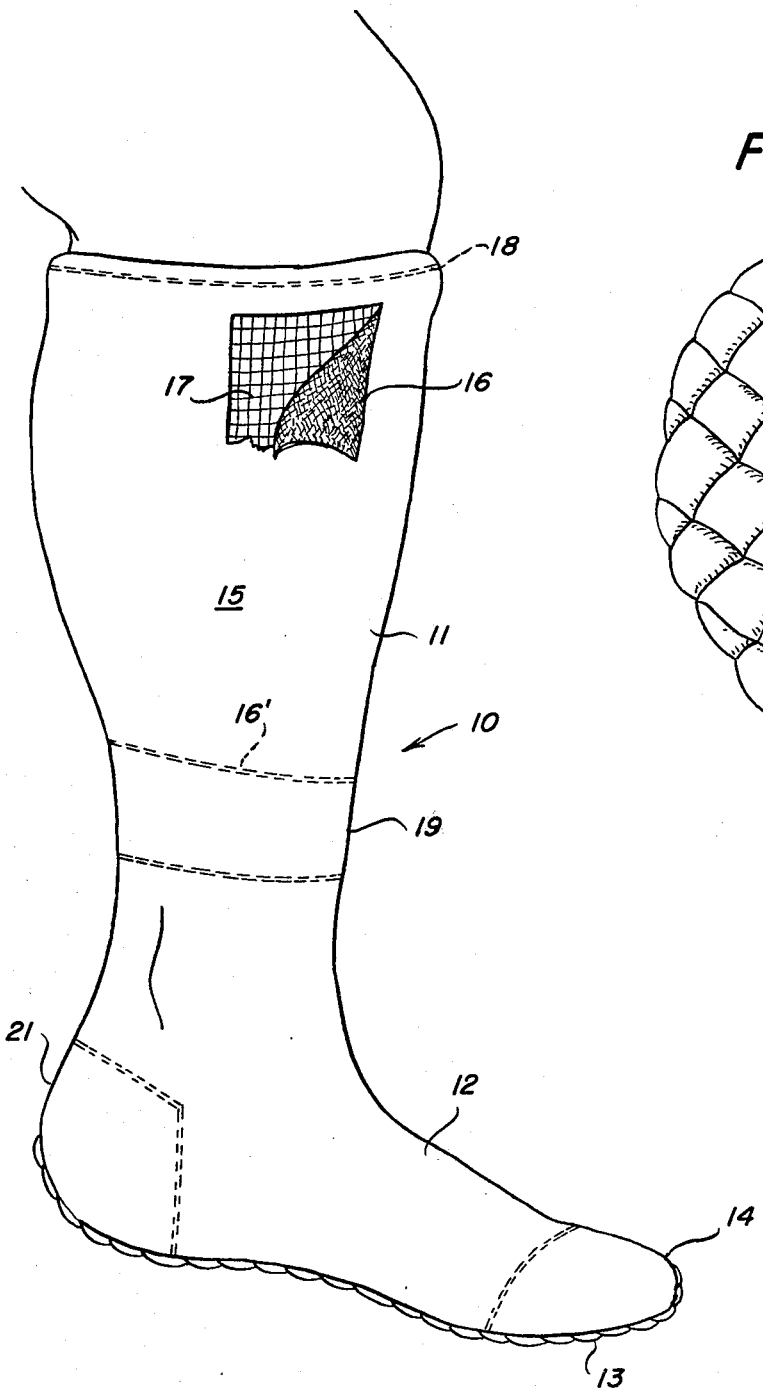
Fig. 1
Fig. 2
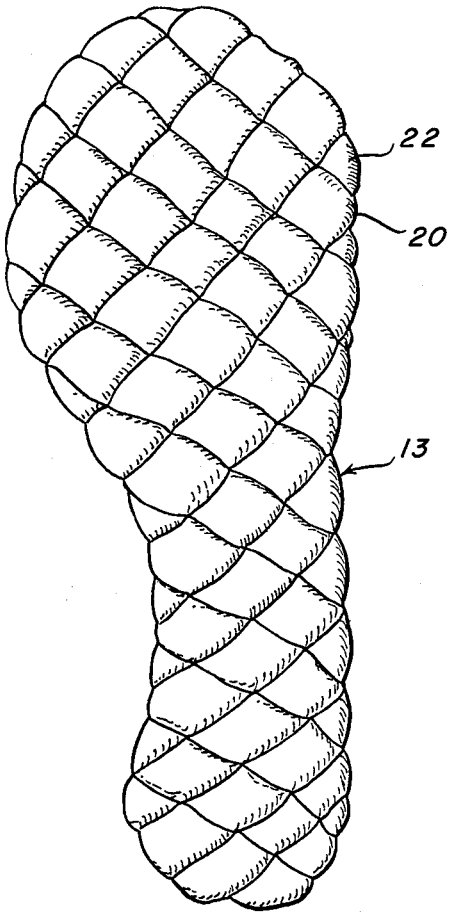

ATHLETIC SOCK

BACKGROUND OF THE INVENTION

The present invention relates to improved athletic foot apparel and more particularly to apparel which provides muscular support and a cushioning effect against shock to the foot bottom.

Common cotton socks have been in widespread use as athletic foot apparel for many years. It is also common for an athlete to provide muscle support, e.g. to a calf muscle, etc. by wrapping adhesive tape or a strip of elastic material about each foot before donning cotton socks. Certain athletic activity played on hard surfaces, such as basketball courts, places extreme strain on foot and calf muscles while imparting severe shocks to the bottom of feet. As rapid starting and stopping and jumping frequently result in such strain and shock, it is common for basketball players to wrap their feet in elastic bandages for muscle support and to wear several pairs of socks at once to absorb shocks. These bandages tend to abrade adjacent skin and by wearing several pairs of socks, slippage of layers of fabric adds to foot discomfort, particularly when a player attempts to rapidly start or stop.

Accordingly, a need exists for athletic foot apparel in the form of an integral sock which provides muscular support and absorbs shocks effectively without significant skin irritation or discomfort.

OBJECTS OF THE INVENTION

It is an object of the invention to provide improved athletic foot apparel.

It is an additional object of the invention to provide a sock which is suitable for strenuous athletic activity and which supports muscles and absorbs shock to the foot bottom.

It is a further object of the present invention to provide athletic foot apparel which does not impede necessary ventilation of the wearer's calf and foot.

It is yet another object of the invention to provide improved athletic foot apparel which does not abrade adjacent skin when worn.

Other objects of the present invention will be clearly evident from the following disclosure and the accompanying drawing wherein:

FIG. 1 is an elevational view of athletic foot apparel in accordance with the present invention: and FIG. 2 is a bottom view of athletic foot apparel illustrated in FIG. 1.

DESCRIPTION OF PREFERRED EMBODIMENT

Referring now to FIG. 1, illustrated therein is an exemplary embodiment of athletic foot apparel 10 in accordance with the present invention. Apparel 10 is in the form of a sock essentially comprised of calf portion 11, ankle portion 12 and padded bottom 13. Calf portion 11 is preferably formed of an outer, permeable fabric 15 such as cotton, elastic material 16 and inner permeable material or fabric 17. It will be understood that fabrics 15 and 17 extend over the entire apparel 10 while elastic material 16 extends over ankle portion 12 and upwardly from stitching 16' to stitching 18 at the top of apparel 10. Although it is preferred in accordance with the present invention to interleave elastic material 16 between layers 15 and 17, it will be understood that sufficient support for the ankle and calf muscles of the wearer may be provided by weaving strands or threads of elastic material in with the fabric forming layers 15 and 17. However, in the event that elastic material 16 is interleaved between fabric layers 15 and 17 as illustrated in FIG. 1, a section 19 of apparel 10 will not be provided with elastic material 16. Preferably, section 19 is simply comprised of fabric layers 15 and 17 to permit adequate ventilation.

Ankle portion 12 will preferably extend downwardly from the bottom of section 19 so as to cover wearer's ankle and foot mid-section. The portion 14 and heel portion 21 of apparel 10 are typically comprised of only fabric layers 15 and 17, again to provide ventilation to portions of the wearer's foot. Also, by providing toe portion 14, heel portion 21 and section 19 without elastic material 16, excessive muscular supression and the problems attendant thereto are avoided. A further degree of comfort afforded to the wearer of apparel 10 is that direct contact between skin and elastic material 16 is avoided by interleaving material 16 between fabric layers 15 and 17.

Referring now to FIG. 2, illustrated therein is padded bottom 13 of apparel 10 which is preferably provided to extend substantially completely over the complete area of the bottom of the wearer's foot. Padded bottom 13 may comprise two or more fabric layers with the lowermost layer 20 depicted in FIG. 2. Stitching 22 may be configured in a diamond arrangement and serves to prevent layers of fabric 20, etc. forming padded bottom 13 from sliding with respect to one another. Thus, although padded bottom 13 provides a cushion against shocks resulting from strenuous running, jumping, stopping, etc. by the wearer, abrasive irritation of skin on the bottom of the wearer's foot is essentially eliminated. By providing stitching 22 in the configuration of discrete areas such as diamond patterns in fabric 20, a degree of isolation between such areas is effected. This results in the dampening of the horizontal component of shocks to the foot bottom and thus enables a greater degree of comfort to the wearer.

It will be understood that suitable foam material which withstands washing without significant deterioriation may be encased between layers of fabric forming padded bottom 13. Appropriate stitching is provided to avoid sliding of such foam material and the undesirable effects thereof as noted above.

It will be understood by those skilled in the art that the particular embodiment of the invention here disclosed is by way of illustration only and is meant to be in no way restrictive; therefore, numerous changes and modifications may be made without departing from the spirit or scope of the invention as defined by the appended claims.

What is claimed is:

1. Athletic foot apparel in the form of a sock comprising a padded bottom portion, an ankle portion and a calf portion, said ankle portion including two layers of fabric material and a layer of elastic material disposed between said two layers of fabric material and said calf portion including two layers of fabric material and a layer of elastic material disposed between said two layers of fabric material with the elastic layers of said ankle and calf portions being spaced away from one another to provide ventilation to at least a portion of the foot of the wearer with said bottom portion being comprised of a plurality of distinct layers of fabric material separate from the sock stitched together on the outer bottom of the sock in a configuration defining discrete areas to avoid sliding of said fabric layers of said padded bottom with respect to one another.

2. Athletic foot apparel as defined in claim 1 wherein the elastic material of said ankle portion extends around the foot of the wearer with the exception of the toe and heel thereof.

3. Athletic foot apparel as defined in claim 1 wherein said discrete areas are substantially diamond shaped.

* * * * *